US008210075B2

(12) United States Patent
Dozier et al.

(10) Patent No.: US 8,210,075 B2
(45) Date of Patent: Jul. 3, 2012

(54) NON LINEAR CUTTING APPARATUS AND METHOD FOR ITS USE

(75) Inventors: Pamela Dozier, Doylestown, PA (US); Christopher P. Orem, Easton, PA (US)

(73) Assignee: Crayola LLC, Easton, PA (US)

( * ) Notice: Subject to any disclaimer, the term of this patent is extended or adjusted under 35 U.S.C. 154(b) by 588 days.

(21) Appl. No.: 12/352,359

(22) Filed: Jan. 12, 2009

(65) Prior Publication Data

US 2010/0175524 A1 Jul. 15, 2010

(51) Int. Cl.
*B26B 27/00* (2006.01)
*B26B 29/02* (2006.01)

(52) U.S. Cl. ..... 83/13; 30/2; 30/293; 30/321; 30/286

(58) Field of Classification Search ..... 30/2, 151, 30/154, 331, 339, 246, 286, 292–295, 314, 30/317, 320, 321, 330; 83/13
See application file for complete search history.

(56) References Cited

U.S. PATENT DOCUMENTS

| | | | | | |
|---|---|---|---|---|---|
| 1,737,552 | A | * | 12/1929 | Altman et al. | 30/370 |
| 2,018,149 | A | * | 10/1935 | Randle et al. | 30/2 |
| 2,209,751 | A | * | 7/1940 | Wulff | 30/156 |
| 2,222,328 | A | * | 11/1940 | Ward | 30/320 |
| 3,922,784 | A | * | 12/1975 | Prince et al. | 30/317 |
| 4,691,438 | A | * | 9/1987 | Insolio | 30/164.95 |
| 5,116,351 | A | * | 5/1992 | Frassetti | 606/167 |
| 5,241,750 | A | * | 9/1993 | Chomiak | 30/2 |
| 5,330,494 | A | * | 7/1994 | van der Westhuizen et al. | 606/167 |
| 5,400,512 | A | * | 3/1995 | Brush | 30/321 |
| 5,478,346 | A | * | 12/1995 | Capewell | 606/167 |
| 5,727,328 | A | * | 3/1998 | Kim | 30/526 |
| 6,560,873 | B1 | * | 5/2003 | Ortner et al. | 30/2 |
| 6,578,266 | B2 | * | 6/2003 | Chomiak | 30/2 |

* cited by examiner

*Primary Examiner* — Laura M. Lee
(74) *Attorney, Agent, or Firm* — Shook, Hardy & Bacon L.L.P.

(57) ABSTRACT

A pen-shaped cutting apparatus and a method for its use is disclosed. The cutting apparatus has a body and a cutter head pivotally mounted thereto. The cutter head includes a swivel-mounted cutter housing that includes a cutter protruding slightly from a lower surface of the cutter housing. The cutting apparatus enables continuous non-linear cutting of an underlying surface.

14 Claims, 7 Drawing Sheets

NON LINEAR CUTTING APPARATUS AND METHOD FOR ITS USE

BACKGROUND OF THE INVENTION

Field of the Invention

The present invention generally relates to a cutting apparatus, and specifically to a pen-shaped cutting apparatus having a swivel-mounted cutter at a cutting end thereof.

SUMMARY OF THE INVENTION

The present invention provides a cutting apparatus having a generally pen-shaped body and a cutting head pivotally mounted to the body. The pen-shaped body comprises a handle and a housing received in a channel of the handle. The cutting head is pivotally mounted to the pen-shaped body at the proximal end of the housing and comprises a dome-shaped shroud and a cutting member. The cutting member is rotatably mounted to the shroud.

In another aspect of the present invention, a method for non-linear cutting is disclosed having the steps of: (i) providing a cutting apparatus having a pen-shaped body and a cutting head pivotally mounted thereto, the cutting head comprising a dome-shaped shroud and a cutting member; and (2) pressing the cutting head against an underlying surface; and (3) guiding the cutting apparatus in a desired path of cutting.

BRIEF DESCRIPTION OF THE DRAWINGS

In order to clearly show and make better comprehension of these and other features and advantages of the present invention, the present invention will now be described by way of example, with reference to a specific embodiment illustrated in the drawings, in which.

DETAILED DESCRIPTION OF THE PREFERRED EMBODIMENT

Figure 1:
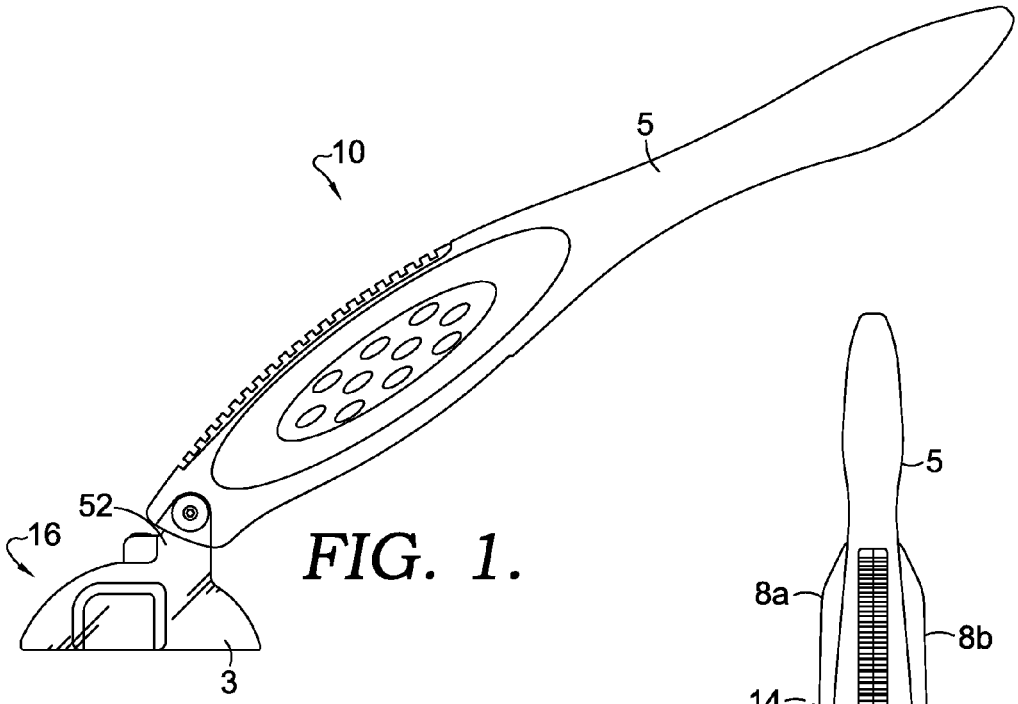
FIG. 1 shows a side elevational view of a cutting apparatus according to a preferred embodiment of the present invention.
Figure 3:
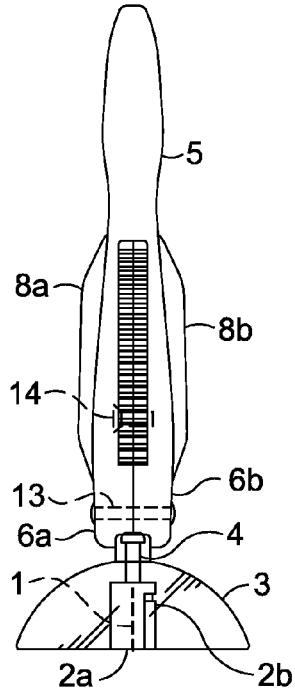
FIG. 3 shows a front elevational view of the cutting apparatus according to the present invention.
Figure 4:
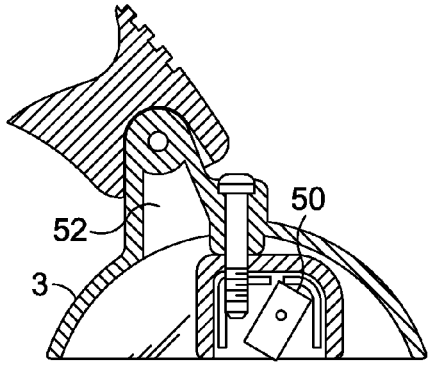
FIG. 4 is a cross-sectional view taken along line C-C of FIG. 3 of the cutting apparatus according to the present invention.
Figure 2:
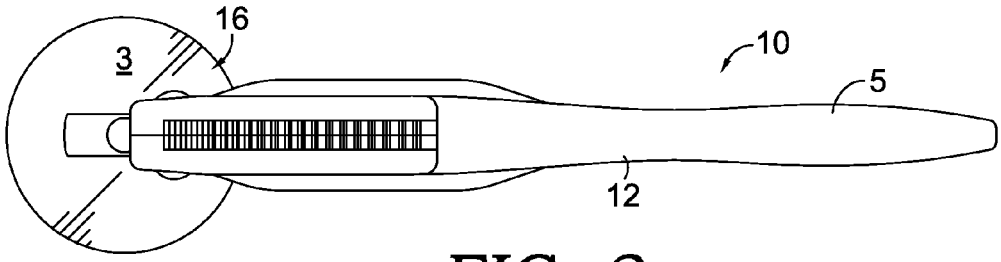
FIG. 2 shows a top plan view of the cutting apparatus according to the present invention.

With reference to the drawings and in particular to FIGS. 1 and 2, which show, respectively, a perspective view and an exploded view of a cutting apparatus, indicated generally at 10, constructed in accordance with a preferred embodiment of the present invention. The cutting apparatus 10 comprises a generally pen-shaped body 12 and a cutting head 16 pivotally mounted to the body.

Figure 5:
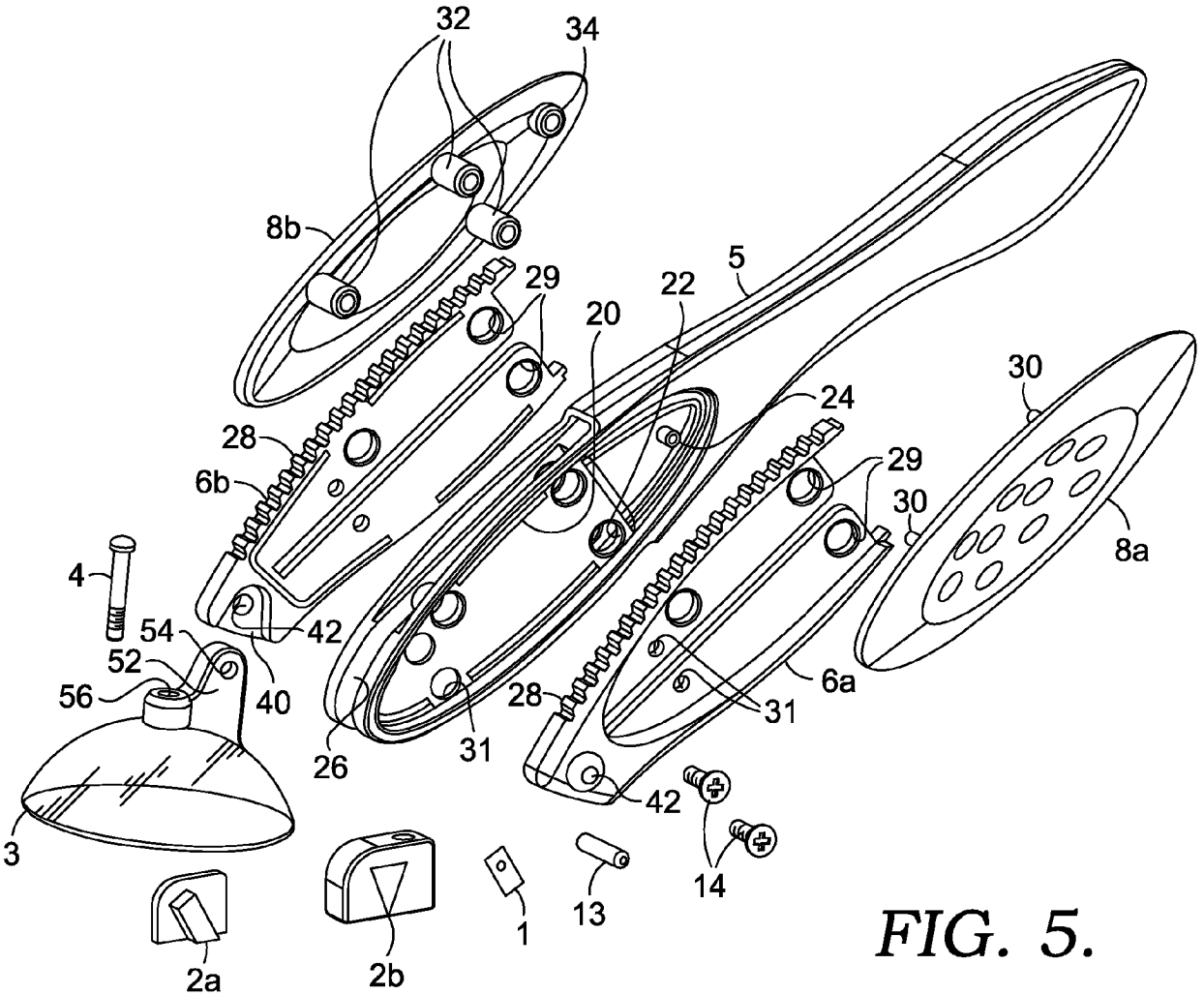
FIG. 5 is an exploded view of the cutting apparatus according to the present invention.
Figure 6:
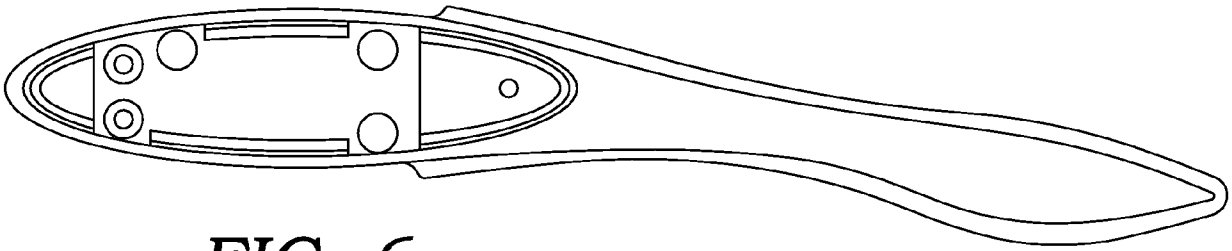
FIG. 6 is a side elevational view of the handle of the cutting apparatus according to a preferred embodiment of the present invention.
Figure 7:
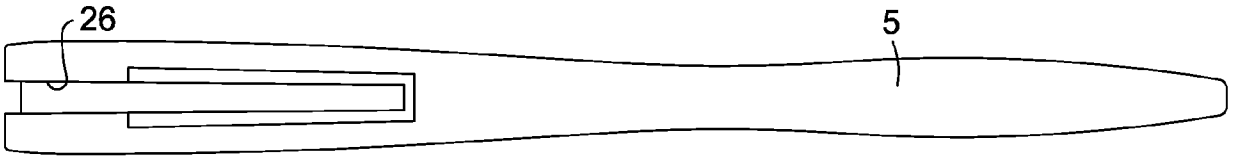
FIG. 7 is a top plan view of the handle of the cutting apparatus according to a preferred embodiment of the present invention.
Figure 8:
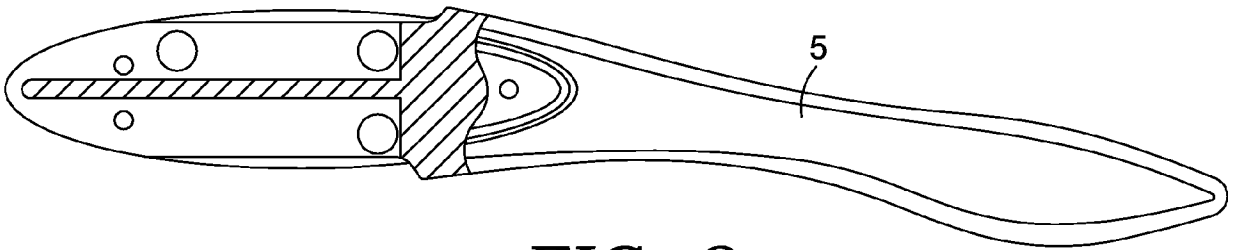
FIG. 8 is a cross-sectional view taken along line D-D of FIG. 7 according to a preferred embodiment of the present invention.
Figure 9:
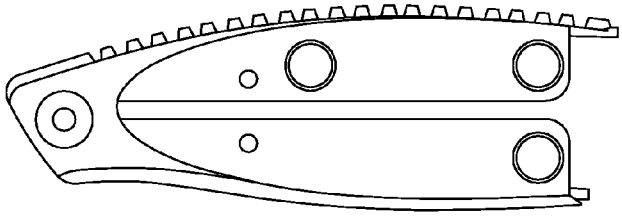
FIG. 9 is a side elevational view of a housing of the cutting apparatus according to the present invention.
Figure 10A:
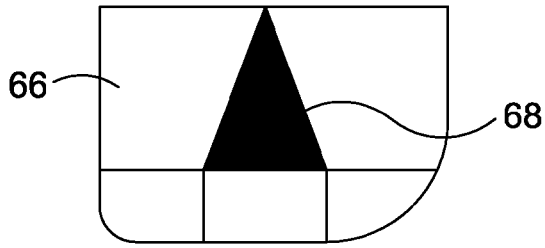
FIG. 10A-C are several views of a cutting housing of the cutting apparatus of the present invention.
Figure 10B:
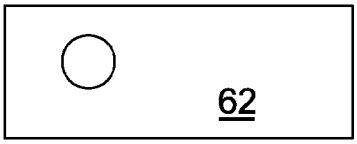
Figure 10C:
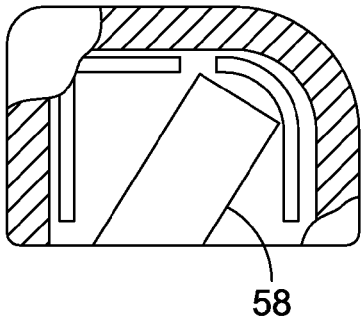
Figure 11:
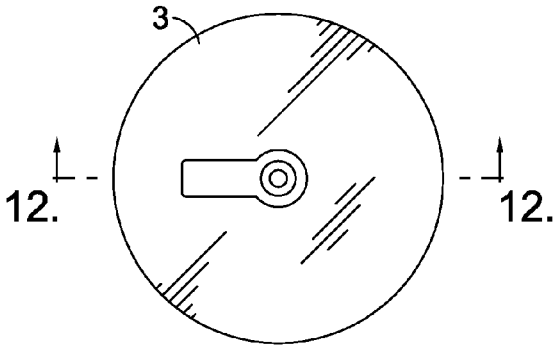
FIG. 11 is a top plan view of a shroud of the cutting apparatus of the present invention.
Figure 12:
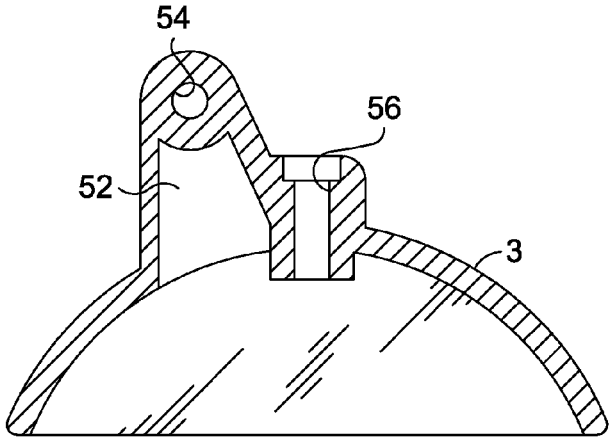
FIG. 12 is a top plan view of a shroud of the cutting apparatus of the present invention.
Figure 13:
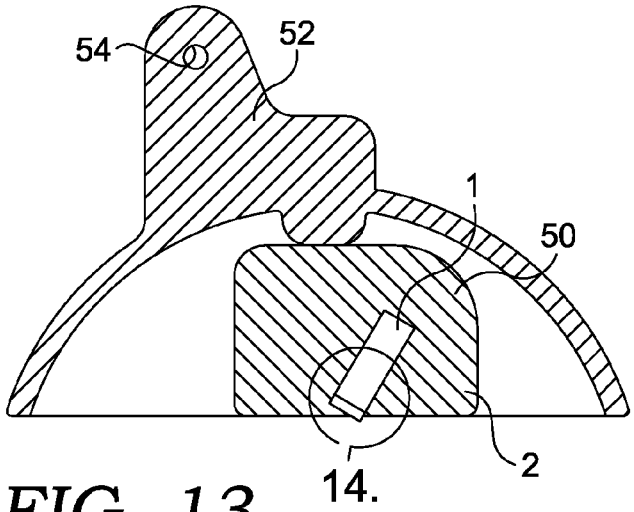
FIG. 13 is a cross-sectional view taken along line E-E of FIG. 12 according to a preferred embodiment of the present invention.
Figure 14:
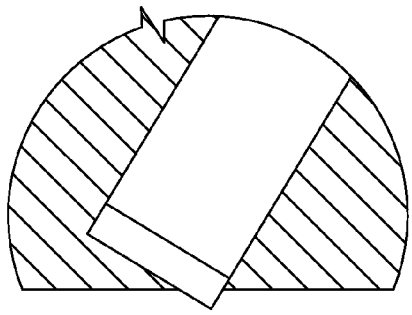
FIG. 14 is a close-up cross-sectional view taken along line E-E of FIG. 12 showing the blade according to a preferred embodiment of the present invention.

As shown in FIG. 5, the pen-shaped body comprises a handle 5 preferably made of a plastic material and having a distal end and a proximal end, and a mount housing 6 for pivotal attachment of the cutting head 16, and a grip. The handle 5 is formed with opposing recessed areas 20 having apertures 22 extending transversely therethrough. The handle further includes opposing posts 24 formed in a distal portion of the recessed areas 20. Handle 5 likewise includes a channel 26 extending through the proximal portion thereof.

The mount housing 6 comprises two housing portions 6A, 6B. The housing portions are received in channel 26 of the handle and each includes a toothed upper edge 28 for aid in gripping the pen. Each housing portion 6A, 6B has one or more apertures 29 that are operably configured to align with apertures 22 of the handle 5 as the housing portions are received in channel 26 of handle 5. The handle 5 and housing portions 6A and 6B further include threaded apertures 31 to receive screws 14 to secure the grip housing to the handle 5. Each housing portion 6A and 6B further includes an interior recessed portion 40 at a proximal end of each housing portion. Each recessed portion has a bore 42 extending transversely therethrough.

The grip comprises a pair of grip members, 8A and 8B, that are mounted to the opposing recessed areas 20 of the handle. Grip member 8A includes a plurality of posts 30 on an interior surface thereof. The posts 30 are received in a corresponding number of female members 32 formed on an interior surface of grip member 8B. The posts and female members extend through the apertures 22 of the handle 5 and apertures 29 of the housing portions 6A and 6B. Grip members 8A and 8B each further include a receiving member 34 for receiving one post 24 of the handle 5. The mating of posts 30 to female members 32 and posts 24 in receiving members 34 secure the grip portions to handle 5.

The housing portions 6A and 6B and the handle 5 are preferably made of a thermoplastic, such as acrylonitrile butadiene styrene (ABS). Grip members 8A and 8B are made of a pliable plastic, such as a thermoplastic elastomer, to provide a softer, gripping surface to hold the pen. The handle further is ergonomically shaped to facilitate cutting.

The cutting head 16 is pivotally mounted to the pen-shaped body 12 at the proximal end of the housing portions 6A and 6B. The cutting head 16 comprises a dome-shaped shroud 3 and a cutting member 50 rotationally mounted to the shroud. Preferably, the shroud 3 is transparent such that the user can see the cutting member 50 during use of the cutting member. The shroud 3 includes a mount portion 52 having a transverse aperture 54 and a generally vertical aperture 56. The mount portion 52 is operably configured to be received within the two interior recessed portions 40 of housing portions 6A and 6B. A pin 13 extends through aperture 42 of the housing portions and through aperture 54 of mount portion 52 to secure the cutting head 16 to the body 12. Cutting head 26 is thus pivotably received on body 12 and has an axis of rotation along the longitudinal length of pin 13. The cutting head 16 pivots for a relatively small arc, between 10 degrees and 30 degrees of rotation, around the axis of rotation. The combined interior recessed portions of 40 of the housing members define an opening slightly larger than the dimension of mount portion 52, which provides a stop for the amount of rotation.

The cutting member 50 comprises a cutter housing 2 that secures blade 1. The cutter housing 2 comprises a first and second cutter housing portion, 2A and 2B, respectively, each having an upper surface 62, a lower surface 64, and an exterior side surface 66 extending between the upper surface and lower surface. The cutter housing portions 2A and 2B include a blade mount 58 for securing blade 1 at an angle such that a portion of the blade extends at an angle slightly below the lower surface 64. Preferably the blade is mounted approximately 30 degrees from vertical and the portion of the blade protrudes approximately 0.006 in. below the lower surface of the cutter housing. The second housing portion 2B includes a pin bore 60 on its upper surface 62. The exterior surface of both the first and second housing portions 2A, 2B, each comprise an indicia 68 corresponding to the exit point of blade from the cutter housing portions. The cutter housing 2 is rotatably mounted to the shroud 3 through a pin 4 that extends through the generally vertical aperture 54 of the shroud and secured in pin bore 60. The cutter housing 2, and thus blade 1, are rotatable about the longitudinal axis of pin 4. The blade preferably is ceramic, such as zirconium dioxide.

In operation, a user holds the cutting apparatus in one hand squeezing opposite sides of the gripping member, while applying slight downward pressure on the toothed upper surface such that the blade of the cutting member engages an underlying surface. The cutting apparatus is then moved along the underlying surface with the cutting apparatus cutting at a position indicated by the indicia. The cutter housing 2, and thus blade 1, is fully rotatable and can easily cut circles or other non-linear shapes, as well as linear shapes.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A cutting apparatus configured to enable continuous cutting of an underlying surface along non-linear paths, the cutting apparatus comprising:

a body; and a cutting head pivotally mounted to the body and including a substantially dome-shaped and substantially transparent shroud, the shroud extending from a coupling with the body and forming a proximal edge, a cutter housing rotatably mounted inside the shroud, and a blade mounted to the cutter housing and extending a distance beyond a plane formed by the proximal edge of the shroud, wherein the proximal edge of the shroud is in contact with an underlying surface, the blade extends into the underlying surface, and the shroud prevents contact with the cutter housing.

2. The cutting apparatus of claim 1, wherein the blade is substantially rectangular and the blade is mounted at an angle with respect to a lower surface of the cutter housing.

3. The cutting apparatus of claim 2, wherein the blade extends below the lower surface of the cutter housing.

4. The cutting apparatus of claim 2, wherein only a portion of the blade extends below the lower surface of the cutter housing.

5. The cutting apparatus of claim 2, wherein the cutter housing further includes indicia indicating the location of a leading edge of the portion of the blade that extends below the surface of the cutter housing.

6. The cutting apparatus of claim 1, wherein the body comprises upper and lower stops for limiting the pivot of the cutting head relative to the body.

7. The cutting apparatus of claim 1, wherein the body further comprises a pliable grip for facilitating handling of the cutting apparatus.

8. The cutting apparatus of claim 1, wherein the body further comprises a handle formed from a thermoplastic.

9. The cutting apparatus of claim 7, wherein the grip is formed of a thermoplastic elastomer.

10. A method for continuously cutting non-linear shapes comprising the steps of:

providing a cutting apparatus having a body and a cutting head pivotally mounted to the body, the cutting head including a substantially dome-shaped and substantially transparent shroud, the shroud extending from a coupling with the body and forming a proximal edge, a cutter housing rotatably mounted inside the shroud, and a blade mounted to the cutter housing and extending a distance beyond a plane formed by the proximal edge of the shroud, the proximal edge of the shroud being in contact with an underlying surface, the blade extending into the underlying surface, and the shroud preventing user contact with the cutter housing;

placing an edge of the shroud against an underlying surface;

pressing the cutter housing of the cutting head against the underlying surface; and guiding the body of the cutting apparatus in a desired path of cutting.

11. The method of claim 10, wherein the blade is substantially rectangular and is mounted to the cutter housing at an angle with respect to a lower surface of the cutter housing.

12. The method of claim 11, wherein providing a cutting apparatus further includes mounting the blade such that only a portion of the blade extends below the lower surface of the cutter housing.

13. The method of claim 12, wherein providing a cutting apparatus further includes providing the cutter housing with indicia indicating the location of a leading edge of the portion of the blade that extends below the surface of the cutter housing.

14. The method of claim 10, wherein the step of guiding the body of the cutting apparatus in a desired path of cutting further comprises guiding the body in a non-linear path.

* * * * *